US008033636B2

(12) United States Patent
Inoue

(10) Patent No.: US 8,033,636 B2
(45) **Date of Patent: *Oct. 11, 2011**

(54) INKJET RECORDING APPARATUS

(75) Inventor: Aya Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 846 days.

This patent is subject to a terminal disclaimer.

(21) Appl. No.: 12/042,681

(22) Filed: Mar. 5, 2008

(65) Prior Publication Data

US 2008/0165219 A1 Jul. 10, 2008

Related U.S. Application Data

(63) Continuation of application No. 11/146,079, filed on Jun. 7, 2005, now Pat. No. 7,364,259.

(30) Foreign Application Priority Data

Jun. 14, 2004 (JP) ..... 2004-174996

(51) Int. Cl.
*B41J 2/165* (2006.01)

(52) U.S. Cl. ..... 347/29

(58) Field of Classification Search ..... 347/29, 347/33, 32, 30, 23

See application file for complete search history.

(56) References Cited

U.S. PATENT DOCUMENTS

| | | | | |
|---|---|---|---|---|
| 5,343,228 | A | 8/1994 | Takada | 347/29 |
| 5,394,178 | A | 2/1995 | Grange | 347/32 |
| 5,946,009 | A | 8/1999 | Youn | 347/32 |
| 6,390,592 | B2 | 5/2002 | Okamura | |
| 6,422,679 | B1 | 7/2002 | Aldrich | 347/22 |
| 6,578,949 | B2 | 6/2003 | Takahashi et al. | 347/30 |
| 6,616,264 | B2 | 9/2003 | Mitsuzawa et al. | 347/23 |
| 6,846,063 | B2 | 1/2005 | Spitz et al. | 347/36 |
| 6,913,340 | B2 | 7/2005 | Tanaka et al. | 347/29 |
| 7,140,715 | B2 | 11/2006 | Griesemer et al. | 347/22 |
| 7,364,259 | B2 * | 4/2008 | Inoue | 347/29 |
| 2005/0259126 | A1 | 11/2005 | Tanaka et al. | |

FOREIGN PATENT DOCUMENTS

| | | | |
|---|---|---|---|
| JP | 4-080041 | A | 3/1992 |
| JP | 9-314861 | A | 12/1997 |
| JP | 2001-113714 | | 4/2001 |
| JP | 2001-347688 | A | 12/2001 |
| JP | 2002-254666 | A | 9/2002 |

* cited by examiner

*Primary Examiner* — Kristal Feggins
(74) *Attorney, Agent, or Firm* — Fitzpatrick, Cella, Harper & Scinto

(57) ABSTRACT

An inkjet recording apparatus can reduce operations or time for preliminary discharge and reduce the influence of mist. A recovery mechanism portion is provided in which a slide member on which a cap is mounted is moved along cam surfaces following a movement of a carriage to cause the cap to abut against a recording head for capping. A first preliminary discharge position where ink is discharged from the recording head into the cap and a second preliminary discharge position where a distance between the recording head and the cap is shorter than the distance in the first preliminary discharge position are provided between a recording area where the recording head forms an image on a recording medium and a capping position.

8 Claims, 6 Drawing Sheets

INKJET RECORDING APPARATUS

This application is a continuation of U.S. patent application Ser. No. 11/146,079 filed on Jun. 7, 2005, which issued as U.S. Pat. No. 7,364,259 on Apr. 29, 2008.

BACKGROUND OF THE INVENTION

1. Field of the Invention

The present invention relates to an inkjet recording apparatus that discharges ink from recording means to a recording medium for recording.

2. Related Background Art

In an inkjet recording apparatus that discharges ink from a recording head as recording means to a recording medium such as recording paper for recording, ink is discharged from a fine discharge port for recording, which sometimes causes an increase in viscosity or adhesion of ink resulting from evaporation of the ink near the discharge port, or poor discharge resulting from generation of bubbles in the ink in the discharge port. A wiping operation for wiping a discharge port surface or a suction operation for sucking ink from the discharge port may cause different color ink to be mixed into the discharge port to exert a harmful effect of ink color mixing in a recording image. Thus, after the sucking operation, or during a recording operation or recording standby, preliminary discharge for discharging ink from the discharge port toward an ink receiver is performed to discharge bubbles or mixed color ink or the like together with the ink, and thus new ink is injected into the discharge port or poor discharge or color mixing is prevented.

Generally, a recovery mechanism portion (a maintenance portion) for recovering and maintaining ink discharge performance of recording means is provided in an inkjet recording apparatus. A known recovery mechanism portion of an inkjet recording apparatus that uses recording means mounted on a carriage for recording on a recording medium is such that a slide member on which a cap is mounted is moved along a slider cam portion following a movement of the carriage, and thus the cap is brought into close contact with the recording means for capping. Such a recovery mechanism portion advantageously requires no separate drive source for capping, uses a small number of components, has a simple configuration, and achieves an inexpensive recording apparatus.

Specifically, in the inkjet recording apparatus including the above-mentioned recovery mechanism portion, when the carriage enters the recovery mechanism portion from a recording area, a side surface of the carriage abuts against an abutment portion of the slide member to cause the slide member to follow the movement of the carriage in an entering direction. At this time, the slide member slides along the slider cam portion provided in a recording device body and is raised while moving together with the carriage. Then, when the slide member reaches an uppermost portion of the slider cam portion, the cap mounted on the slide member comes into close contact with a discharge port surface of the recording means to cap the discharge port.

When the carriage reverses its moving course and starts to move toward the recording area, the slide member starts to be lowered along the slider cam portion, and the cap starts to be separated from the discharge port surface of the recording means. When the slide member reaches a stop position at a lowermost portion of the slider cam portion, the carriage is separated from the abutment portion of the slide member, and enters a standby state with the stop position of the slide member being a standby position. Then, when the carriage is in the standby state, required preliminary discharge is performed such as preliminary discharge during standby of the carriage, preliminary discharge during a recording operation, preliminary discharge during a sheet feeding operation, or preliminary discharge after wiping the discharge port surface.

In the above-mentioned recovery mechanism portion, the preliminary discharge required for cleaning (ink refreshing of) the inside of the discharge port in the recording means is performed in the standby position of the carriage at the lowermost portion of the slider cam portion. Thus, it is advantageous that the preliminary discharge is performed during the recording operation in a nearest position to the recording area to reduce an operation time, and the carriage does not abut against the slide member to reduce noise and loads of the carriage.

However, a vertical distance between the discharge port surface of the recording means mounted on the carriage and the slide member placed at the lowermost portion of the slider cam portion is larger than the distance of other positions in the slider cam portion, and ink that is discharged but not dropped into the cap (a cap absorbent) is suspended in the recording device in fine mist. The suspended ink may adhere to components of a conveyance mechanism or trays of sheet feeding and delivering mechanisms in the recording apparatus, and transferred to the recording medium, thereby causing contamination. The ink in fine mist may be distributed out of the recording apparatus to cause the ink to adhere to a desk on which the recording apparatus is placed or peripheral equipment.

SUMMARY OF THE INVENTION

The present invention can provide an inkjet recording apparatus that reduces operations or time for preliminary discharge and reduces the influence of mist.

The present invention can also provide an inkjet recording apparatus that discharges ink from recording means to a recording medium for recording, including: a carriage that reciprocates with the recording means being mounted thereon; a cap that caps a discharge port surface of the recording means and receives ink preliminarily discharged from the recording means; and a slide member that holds the cap and follows the movement of the carriage, wherein the carriage includes a first position and a second position where preliminary discharge from the recording means to the cap is performed, and a distance between the recording means and the cap in the first position is different from a distance between the recording means and the cap in the second position.

DETAILED DESCRIPTION OF THE PREFERRED EMBODIMENTS

Figure 1:
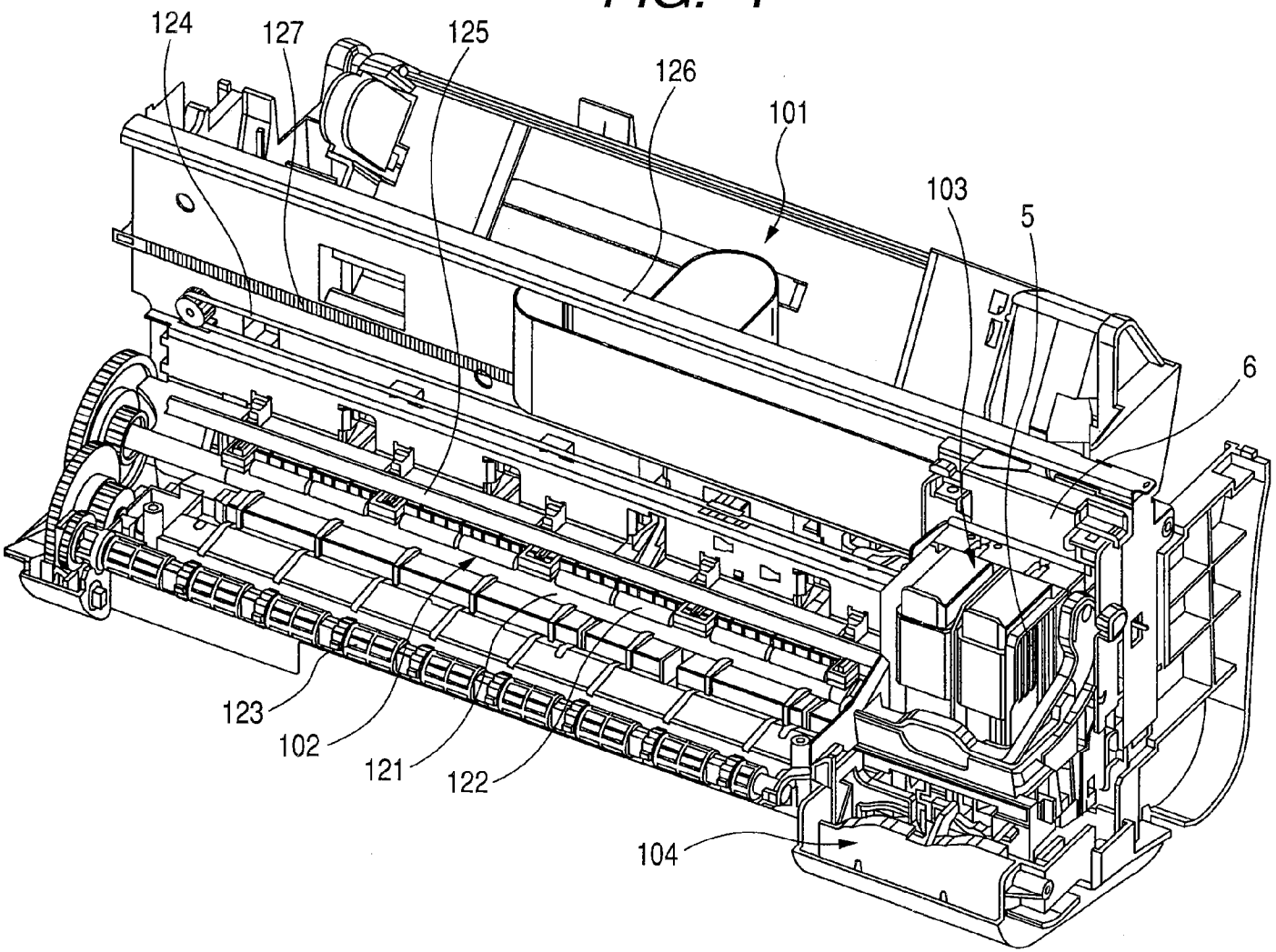
FIG. 1 is a perspective view of an inkjet recording apparatus according to an embodiment of the present invention.

Now, an embodiment of the present invention will be described with reference to the drawings. The same reference numerals denote the same or corresponding parts throughout the drawings. FIG. 1 is a perspective view of an inkjet recording apparatus according to an embodiment of the present invention. In FIG. 1, the inkjet recording apparatus includes a sheet feeding portion 101 for feeding a recording medium such as recording paper into an apparatus body, a conveyance portion 102 for conveying the recording medium through the apparatus body (a recording portion or the like), a recording mechanism portion 103 (a carriage portion) for recording an image on the recording medium based on image information, and a recovery mechanism portion 104 (a maintenance portion) for maintaining and recovering quality of the image formed by the recording mechanism portion 103.

Recording media stacked on the sheet feeding portion 101 are separated one by one by a sheet feeding roller driven by a sheet feeding motor and fed into the conveyance portion 102. The recording medium fed into the conveyance portion 102 is conveyed through a recording portion by a nip between a conveyance roller 121 driven by a conveyance motor and a pinch roller 122 that is pressed by the conveyance roller and follows the rotation of the conveyance roller, and an image is recorded by the recording-mechanism portion 103 during the conveyance. The recording medium on which the image is recorded is discharged out of the apparatus body by a discharge roller 123 interlocked with the conveyance roller 121 and a spur that cooperates with the discharge roller.

The recording mechanism portion 103 includes a carriage 6 guided and supported reciprocatably in a main scanning direction in the apparatus body, and recording means (a recording head) 5 mounted on the carriage, or the like. Specifically, the carriage 6 on which the recording means 5 is mounted is guided and supported reciprocatably along a guide shaft 125 and a guide rail 126 placed in parallel with the apparatus body. A drive force of a carriage motor 70 is transferred to the carriage 6 via a carriage belt 124, and thus the carriage 6 is reciprocated along the guide shaft 125. A cord strip 127 for detecting the movement and a position of the carriage 6 is provided in parallel with the guide shaft 125. Then, the recording means 5 is driven based on image information in synchronization with the movement of the carriage 6 to perform recording (main scanning) for one line, and then the conveyance roller 121 is driven by a predetermined amount by an LF motor 69 to convey the recording medium by a predetermined pitch (sub scanning) and perform recording for the next line. These operations are repeated to perform recording on the entire recording medium.

The recovery mechanism portion 104 is provided for maintaining and recovering recording quality in a satisfactory state by eliminating clogging of the recording means 5, and includes pumping means for sucking or discharging ink through a discharge port, capping means for capping the discharge port, and wiping means for wiping and cleaning a discharge port surface, or the like. The recording means 5 in the embodiment causes film boiling in the ink by thermal energy applied by an electrothermal transducer, discharges the ink from the discharge port using a pressure change resulting from the growth and contraction of bubbles for recording. The electrothermal transducer is provided correspondingly to each of a plurality of discharge ports that form a discharge port array, and a pulse voltage is applied to a corresponding electrothermal transducer according to recording information to discharge ink from a corresponding discharge port.

Figure 2:
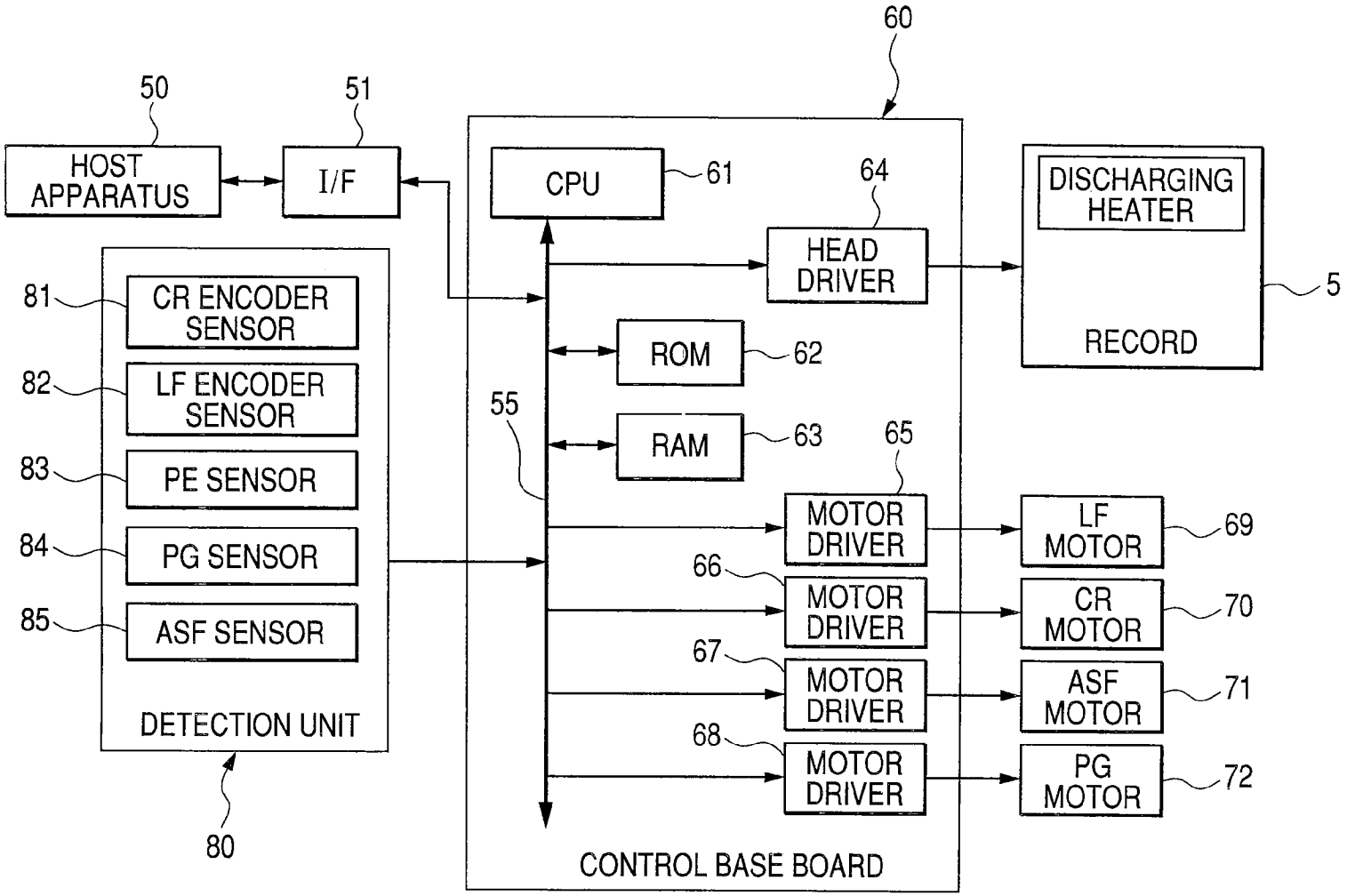
FIG. 2 is a block diagram of a schematic configuration of control means of the inkjet recording apparatus in FIG. 1.

FIG. 2 is a block diagram of a schematic configuration of control means of the inkjet recording apparatus in FIG. 1. In FIG. 2, a control base board 60 as the control means of the recording apparatus is connected to a host apparatus 50 such as a computer via an interface 51. A central processing unit (CPU) 61 constituted by a microprocessor is provided on the control base board 60, and a ROM 62, a RAM 63, a head driver 64, and motor drivers 65, 66, 67 and 68 are connected to the CPU 61 via a main bus 55. On the other hand, in the recording apparatus, a detection unit 80 is provided which is constituted by sensing means such as a CR (carriage) encoder sensor 81, an LF (line feed) encoder sensor 82, a PE (paper end) sensor 83, a PG (recovery system) sensor 84, and an ASF (automatic sheet feeding) sensor 85.

Information such as programs or data stored for a long time is stored in the ROM 62, and information such as writable data is stored in the RAM 63. Then, when detection signals from the various sensors 81 to 85 of the detection unit 80 are input to the control base board 60 via the main bus 55, an arithmetical operation based on the information stored in the ROM 62 and the RAM 63 is performed by the CPU 61 on the control base board 60, and operations of corresponding mechanism portions are performed via various drivers. Specifically, the recording means 5 is controlled via the head driver 64 to perform a recording operation, and the LF motor (a conveyance motor) 69 is controlled via the motor driver 65 to convey the recording medium.

The movement in the main scanning direction of the carriage 6 guided and supported by the guide shaft 125 and the guide rail 126 is stopped by controlling the carriage motor 70 via the motor driver 66. Further, an ASF motor (a sheet feeding motor) 71 is controlled via the motor driver 67 to perform a sheet feeding operation of the recording medium from the sheet feeding portion 101 to the recording portion, and a PG motor 72 is controlled by the motor driver 68 to perform a recovery operation of each recovery means of the recovery mechanism portion (the maintenance portion).

Figure 3:
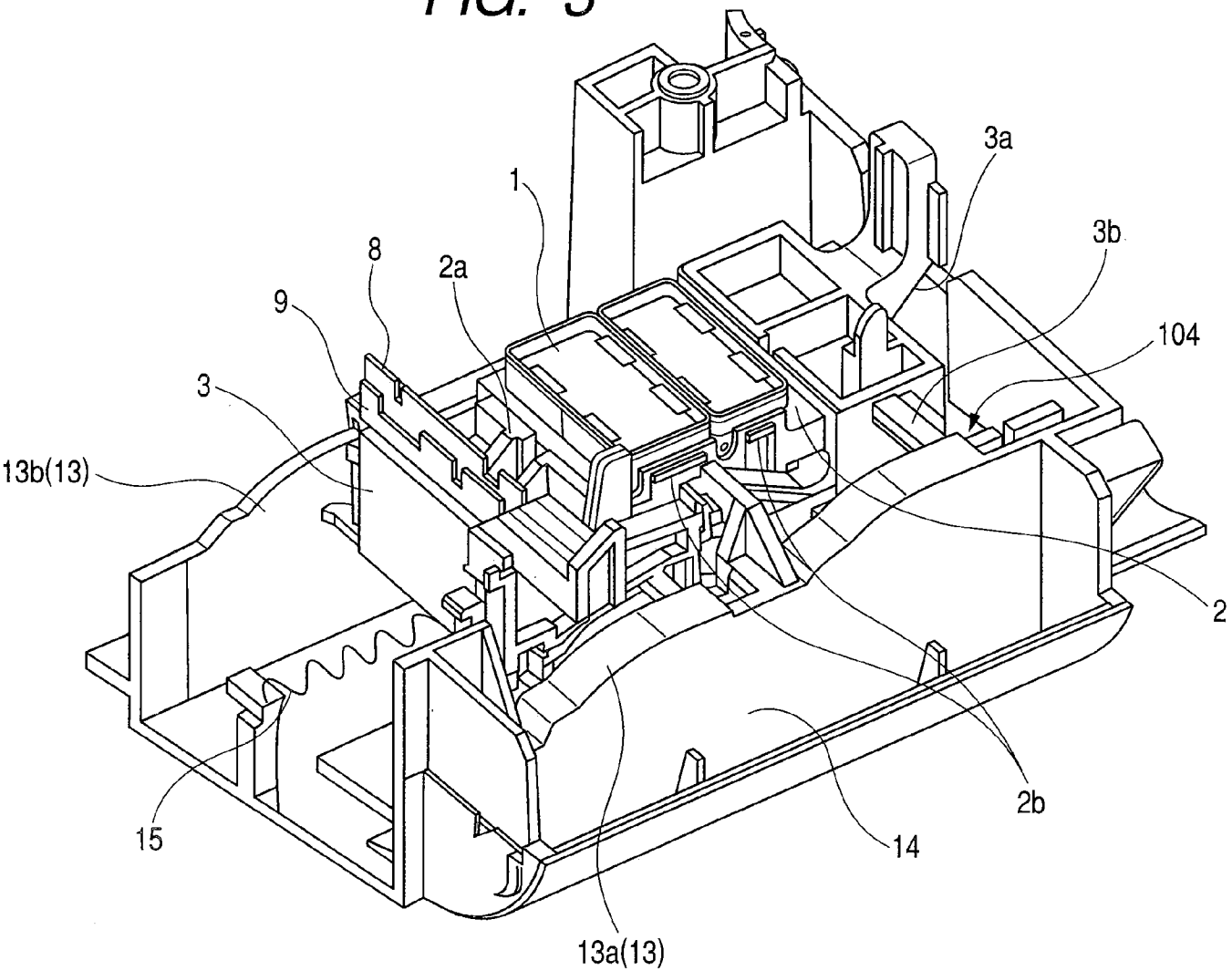
FIG. 3 is a perspective view of a recovery mechanism portion of the inkjet recording apparatus according to the embodiment seen obliquely from above.

FIG. 3 is a perspective view of the recovery mechanism portion 104 of the inkjet recording apparatus according to the embodiment seen obliquely from above. In FIG. 3, a cap holder 2 that holds a cap 1 formed by a molded article of a rubber elastic material is mounted vertically movably with respect to a slide member 3 with an upper limit position being defined by four pawls 2*b*, and is urged upward by a cap spring (not shown) provided between the cap holder 2 and the slide member 3 and thus vertically positioned. Usually, an ink absorbent (a cap absorbent) made of a porous member or the like and having a high ink absorption capacity is loaded in the cap 1. A suction port (not shown) connected to a suction pump (not shown) is formed in a bottom surface of the cap 1, a suction tube (not shown) is connected to a portion of the cap holder 2 corresponding to the suction port, and the other end of the tube is connected to a suction pump as negative pressure generation means. Thus, the pump is driven with the recording means (the recording head) 5 being capped with the cap 1 to cause a negative pressure in the cap 1 via the tube, thereby allowing ink to be sucked from the discharge port of the recording means 5. This ink suction allows the ink in the discharge port to be refreshed to recover and maintain ink discharge performance.

The slide member 3 that holds the cap holder 2 is connected to a base portion 14 of the apparatus body via a slider spring 15. Bar-like protrusions (slider shafts) 3*b* protruding laterally are provided in four places on the right and left in front and back surfaces of the slide member 3, and the protrusions 3*b* abut against cam surfaces (upper surfaces) of a slider cam portion 13 provided on the base portion 14. The slider cam portion 13 is constituted by a slider cam 13*a* provided on a front side of the recovery mechanism portion 104 and a slider cam 13*b* provided on a back side. Specifically, the slide member 3 is fitted movably in a moving direction of the carriage 6 along the slider cams 13*a* and 13*b* with the protrusions 3*b* being urged downward by the slider spring 15 and caused to slidably abut against the cam surfaces of the slider cams 13*a* and 13*b*.

An abutment portion 3*a* against which the carriage 6 that enters (is moved to) the recovery mechanism portion 104 (the maintenance portion) abuts is provided in the slide member 3. Specifically, when the carriage 6 is moved to the recovery mechanism portion 104 and the side surface of the carriage abuts against the abutment portion 3*a*, the slide member 3 is also moved following the carriage 6 entering the recovery mechanism portion 104.

The slide member 3 is moved along the slider cam portion 13 by the entering carriage 6, the carriage 6 is stopped when and the slide member reaches an uppermost portion of the slider cam portion 13, and thus the cap 1 is brought into close contact with the discharge port surface of the recording means 5 to cap the discharge port. When the carriage 6 further enters, a protrusion provided in the base portion 14 abuts against part of the cap holder 2 to cause a portion downstream (on a front side of the apparatus body) in a recording medium conveyance direction of the cap holder 2 to be tilted in a lowering direction. The tilt of the cap holder 2 causes part of the cap 1 having capped the discharge port surface to be separated from the discharge port surface and thus forcefully provide communication between the inside of the cap 1 and outside air. Wipers 8 and 9 made of a rubber elastic material for wiping and removing ink or dust deposited on the discharge port surface of the recording means 5 is provided at an end of the slide member 3 on the side of the recording area.

For example, when the carriage 6 is further moved after a suction recovery operation for driving the suction pump in the capped state to suck the ink from the discharge port, the inside of the cap 1 under negative pressure is opened in a stroke. When the discharge port is thus returned from the negative pressure to the atmospheric pressure in a stroke, bubbles or different color ink may be pressed into the discharge port, or ink drawn near to the discharge port may be deposited in a large amount on the discharge port surface. Thus, in order to discharge the ink for solving such problems, preliminary discharge is performed in a cap opening state in the embodiment. The preliminary discharge is an operation of discharging ink from the discharge port into the cap, and performed as one recovery processing of the recording means. The present invention relates to preliminary discharge in a position between the recording area (a moving area for a recording operation of the carriage) and a capping position, but does not directly relate to preliminary discharge in a cap forcefully opening state.

Figure 4:
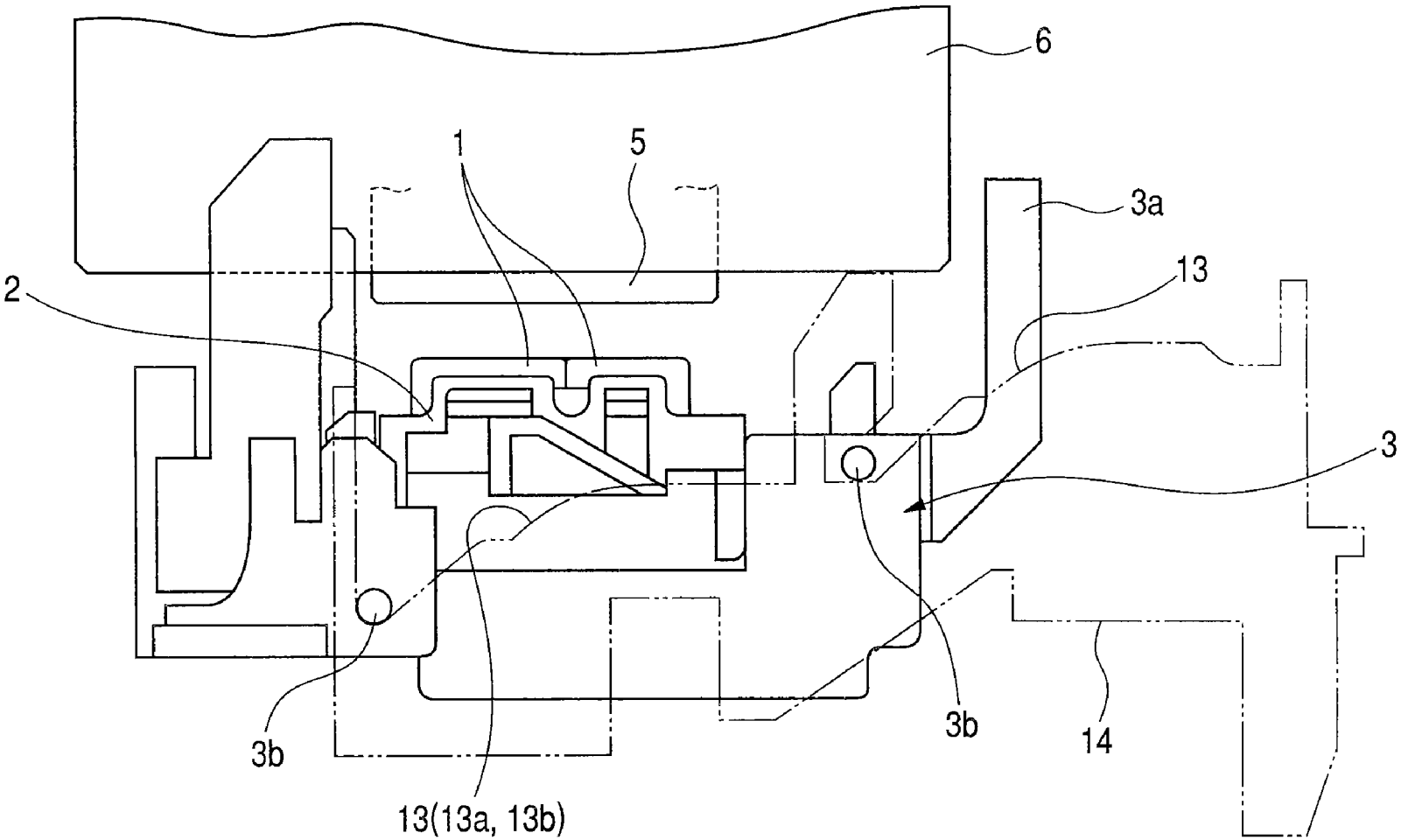
FIG. 4 is a front view of a standby state where a slide member stops at a lowermost portion of a slider cam portion, and a carriage stops without abutting against an abutment portion of the slide portion.
Figure 5:
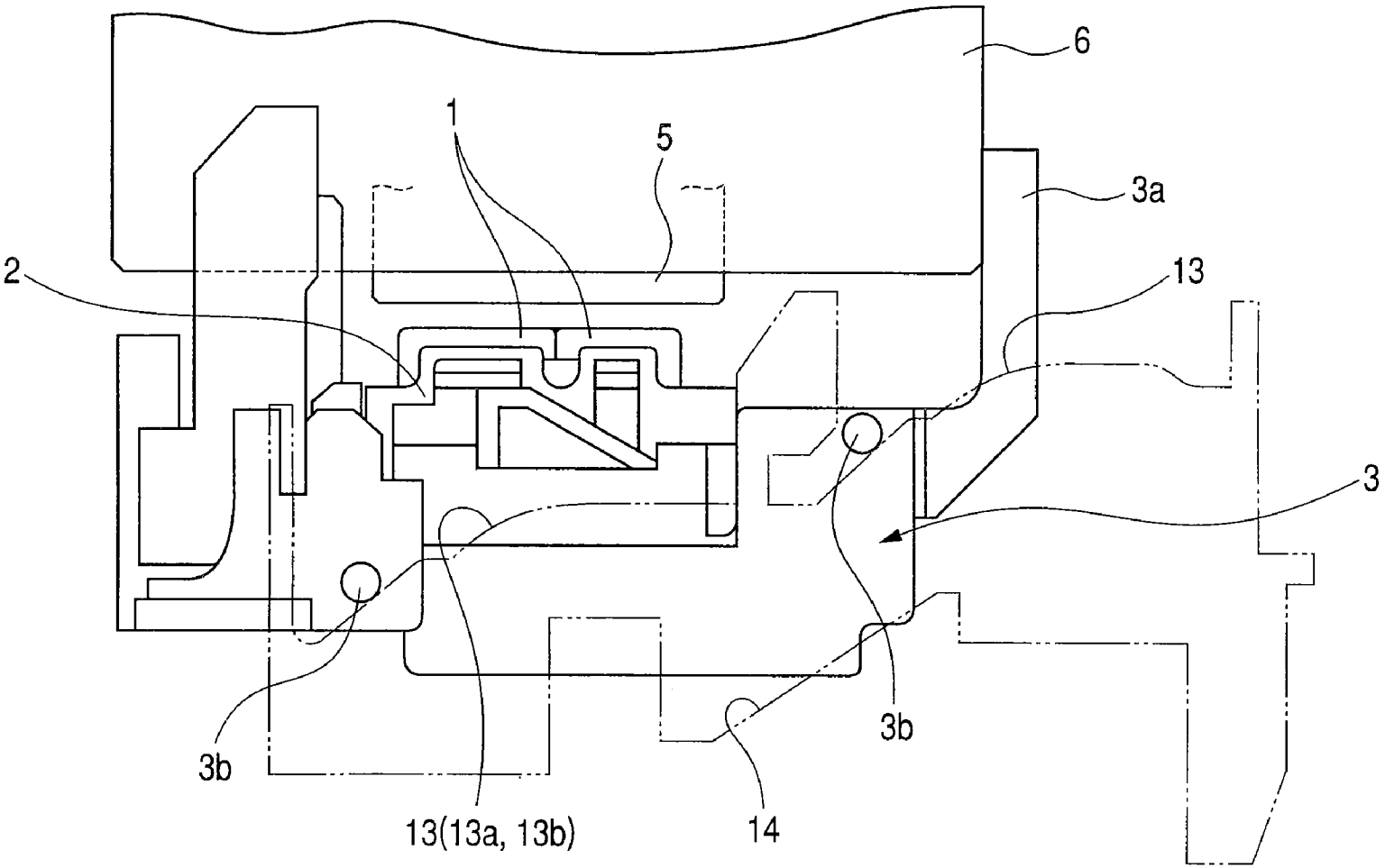
FIG. 5 is a front view of a state where a carriage enters the recovery mechanism portion and then the slide member is moved following the movement of the carriage while the slide member is stopped for preliminary discharge in a middle (an inclined surface portion) of the slider cam portion.
Figure 6:
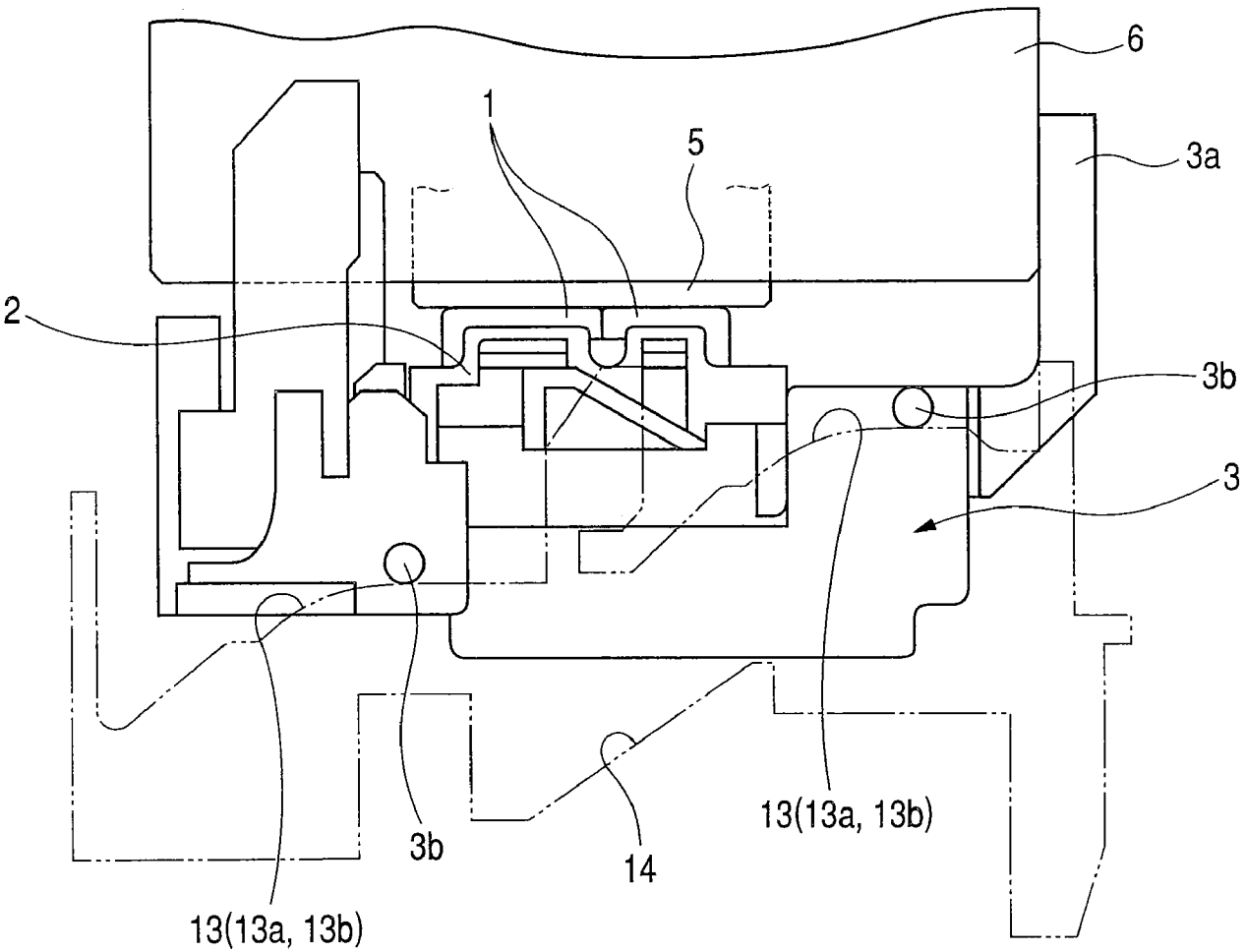
FIG. 6 is a front view of a state where the carriage enters the recovery mechanism portion and then the slide member is moved to an uppermost portion of the slider cam portion following the movement of the carriage to cap recording means.

FIG. 4 is a front view of a standby state where the slide member 3 stops at a lowermost portion of the slider cam portion 13, and the carriage 6 stops without abutting against the abutment portion 3*a* of the slide member, FIG. 5 is a front view of a state where the carriage 6 enters the recovery mechanism portion 104 and then the slide member is moved following the movement of the carriage while the slide member 3 is stopped for preliminary discharge in a middle (an inclined surface portion) of the slider cam portion 13, and FIG. 6 is a front view of a state where the carriage 6 enters the recovery mechanism portion 104 and then the slide member 3 is moved to the uppermost portion of the slider cam portion 13 following the movement of the carriage to cap the recording means 5.

Next, control means of the preliminary discharge that is a characteristic feature of the inkjet recording apparatus to which the present invention is applied will be described in detail with reference to FIGS. 1 to 6. In the embodiment, two positions for performing the preliminary discharge are provided in the slider cam portion 13, and preliminary discharge in each position can be selectively performed according to the amount of discharged ink or a timing or frequency of the preliminary discharge. Specifically, a first preliminary discharge position and a second preliminary discharge position are provided as the preliminary discharge positions. In the embodiment, the slider cam portion 13 is constituted by the two slider cams 13*a* and 13*b* formed in parallel with the moving direction of the carriage 6 in front and back positions of the slide member 3.

Thus, the first preliminary discharge position is set in a position where the slide member 3 abuts against the lowermost portion of the slider cam portion 13, a distance between the recording means 5 and the cap 1 is relatively large, and the carriage 6 does not abut against the abutment portion 3*a* of the slide member 3. The second preliminary discharge position is set in a position where the carriage 6 is stopped with the slide member 3 abutting against the middle of the inclined surface of the slider cam portion 13 to restrict the position and attitude of the slide member 3 and perform the preliminary discharge. A vertical distance between the recording means 5 and the cap 1 is set so that the distance in the second preliminary discharge position is smaller than the distance in the first preliminary discharge position.

Preliminary discharge for discharging ink that is not used for recording from the recording means 5 to an ink receiving portion such as the cap may be frequently performed in order to prevent color mixing caused by different color ink mixed into the discharge port of the recording means 5 or poor discharge caused by ink adhesion resulting from moisture evaporation of ink. For example, in preliminary discharge performed after the wiping operation of the recording means 5 by the wipers 8 and 9 of the recovery mechanism portion 104, when the recording apparatus is powered on/off, or when the cap 1 of the recovery mechanism portion 104 is opened or closed with respect to the recording means 5, a large amount of ink is discharged and thus, in most cases, idle suction for sucking ink in the cap with the carriage being stopped in the standby position is performed after the preliminary discharge.

Such preliminary discharge in which the large amount of ink is discharged is performed in the second preliminary discharge position where the slide member 3 is stopped in the middle of the inclined surface of the cam surface of the slider cam portion 13 (the slider cams 13*a* and 13*b*) as shown in FIG. 5. In the second preliminary discharge position, the distance between the cap 1 (the ink absorbent in the cap) and the discharge port surface of the recording means 5 is smaller than the first preliminary discharge position where the slide member 3 abuts against the lowermost portion of the slider cam portion 13. Thus, the amount of generated ink mist is reduced to reduce the influence of the ink mist.

On the other hand, the preliminary discharge during the recording operation or the recording standby, in which a small amount of ink is discharged, is performed at regular time intervals. For example, the preliminary discharged may be performed in an interrupting manner at intervals of a few seconds, and thus preliminary discharge time exerts an influence on image recording time in the preliminary discharge during the recording operation. Thus, in the preliminary discharge during the recording operation, reduction in operation time is a high priority, and as shown in FIG. 4, the preliminary discharge is performed in the first preliminary discharge position where the slide member 3 abuts against the lowermost portion of the slider cam portion 13 in the nearest position to the recording area.

The first preliminary discharge position is a standby position of the carriage 6 and also used as a position for the preliminary discharge during the standby. The preliminary discharge performed in the first preliminary discharge position is frequently performed, but a small amount of ink is discharged. The first preliminary discharge position is a position for preliminary discharge for preventing a harmful effect by the ink mist, and more significantly, a position for preliminary discharge for eliminating noise caused by the carriage 6 abutting against the abutment portion 3*a* of the slide member 3 or eliminating an entering load applied to the carriage 6.

As described above, the vertical distance between the recording means 5 and the cap 1 (the ink absorbent in the cap) and the distance from the recording area of the carriage 6 in the moving direction are considered according to the frequency or the timing of the preliminary discharge to optimize the first and second preliminary discharge positions, thereby reducing preliminary discharge operations and reducing generation of suspended ink mist. The second preliminary discharge position is determined using the inclined surface in the middle of the cam surface of the slider cam portion 13 (the slider cams 13*a* and 13*b*), thereby allowing fine adjustment of the vertical distance between the recording means 5 and the cap 1. This prevents generation of mist caused by a splash of ink that occurs because of a short distance between the recording means 5 and the cap 1, and prevents ink adhesion near the recovery mechanism portion 104.

The number of the preliminary discharge positions where the preliminary discharge is actually performed is not limited to two as in the embodiment. Depending on the frequency or the timing of the preliminary discharge, control may be performed to switch the preliminary discharge positions to one place only according to a use condition such as the amount of discharged ink besides selecting the two preliminary discharge positions. For example, the amount of the concerned apparatus ink of each color having been discharged from an arrival time may be stored in the ROM 62 of the recording apparatus body, and the preliminary discharge positions may be switched to one place only when the cumulative total amount of discharged ink exceeds a certain threshold. In this case, a predetermined limit value at which a large amount of ink is discharged to increase the amount of ink adhered to the inside of the recording apparatus body by the ink mist is the threshold. Then, when the threshold is exceeded, the two preliminary discharge positions with the different distances between the recording means 5 and the cap 1 are switched to one place only of the second preliminary discharge position with the smaller distance, thereby increasing a preventing effect of the ink mist.

Further, the type(s) of the recording medium, the number of the recording media and recording mode(s) in image forming, from the arrival time, sent from the host apparatus 50 to the inkjet recording apparatus are stored in the ROM 62 of the recording device, and control may be performed to switch the preliminary discharge positions to one place only of the second preliminary discharge position according to the threshold. Besides selecting the two preliminary discharge positions according to the frequency or the timing of the preliminary discharge, the amount of ink of each color having been discharged from the arrival time sent from the host device to the recording apparatus body may be stored, and the preliminary discharge positions may be switched to one place only when the cumulative total amount of discharged ink exceeds a certain threshold. An appropriate value at which a large amount of ink is discharged to increase the amount of ink adhered to the inside of the recording apparatus body by the mist is the threshold. When the threshold is exceeded, the two preliminary discharge positions with the different distances between the recording means 5 and the cap 1 are switched to one place only of the second preliminary discharge position with the smaller distance, thereby increasing a preventing effect of the mist.

Similarly, the type(s) of the recording medium, the number of the recording media and recording mode(s) in image forming, from the arrival time are stored in the recording apparatus body, and the preliminary discharge positions are switched to one place only of the second preliminary discharge position according to the threshold. When image forming on special paper in which a large amount of ink is dropped or recording in a high image quality mode is performed many times, a large amount of mist is distributed in the recording apparatus body, and thus the preliminary discharge is performed in one place only of the second preliminary discharge position to prevent the mist further generated in the recording apparatus.

In the above embodiment, the case where the preliminary discharge positions are provided in the two places between the capping position where the slide member 3 is placed at the uppermost portion of the slider cam portion 13 and the recording area where the recording means 5 performs the recording operation is illustrated, but the present invention is not limited to this, and the preliminary discharge positions may be provided in three or more positions. In the embodiment shown in FIGS. 1 to 6, the recovery mechanism portion 104 is placed on the right of the recording area when the recording apparatus body is seen from the front, but may be placed on the left of the recording area.

The present invention may also be applied to an inkjet recording apparatus using one recording means for recording in a single color or a plurality of colors, a color inkjet recording apparatus using a plurality of recording means for recording in different color ink, or a gradation inkjet recording apparatus using a plurality of recording means for recording in the same color and different densities, and a recording apparatus of a combination thereof, and similar advantages may be obtained. The present invention may also be applied to any arrangement including recording means and an ink tank, such as an arrangement using a changeable ink cartridge with recording means and an ink tank being integrated, or an arrangement of mutually separate recording means and ink tank connected to each other by an ink supply tube or the like, and similar advantages may be obtained. When applied to the inkjet recording apparatus. The present invention may be applied to recording by recording means using an electromechanical transducer such as a piezoelectric element.

According to the embodiment of the present invention, the inkjet recording apparatus is provided that can consider the amount of preliminary discharge or the timing and the frequency of the preliminary discharge to select the preliminary discharge position where the vertical distance between the recording means and the cap and the distance between the recording area and the carriage in the moving direction of the carriage are optimized, reduce the time required for the preliminary discharge, and reduce the influence of the ink mist.

This application claims priority from Japanese Patent Application No. 2004-174996 filed Jun. 14, 2004, which is hereby incorporated by reference herein.

What is claimed is:

1. An inkjet recording apparatus that discharges ink from recording means to a recording medium for recording, comprising:

a carriage that reciprocates with the recording means being mounted thereon;

a cap that caps a discharge port surface of the recording means and receives ink preliminary discharged from the recording means; and a moving means that moves said cap to (1) a first position at which the recording means performs preliminary discharge with a first distance between said cap and the recording means and (2) a second position at which the recording means performs preliminary discharge with a second distance between said cap and the recording means, the second distance being different from the first distance.

2. The inkjet recording apparatus according to claim 1, wherein the first distance is longer than the second distance.

3. The inkjet recording apparatus according to claim 1, wherein said moving means moves said cap, following the movement of said carriage.

4. The inkjet recording apparatus according to claim 3, wherein said carriage is so arranged that when said cap is at the first position, a position of said carriage is closer to a recording area than a position of said carriage when the cap is at the second position.

5. The inkjet recording apparatus according to claim 1, wherein the preliminary discharge to said cap of which the distance from the recording means is the first distance or the preliminary discharge to said cap of which the distance from the recording means is the second distance is selectively performed in dependence upon the frequency or timing of the preliminary discharge from the recording means.

6. The inkjet recording apparatus according to claim 1, wherein an amount of ink from each discharge port, having been discharged since an arrival time, is stored in a recording apparatus body, and control of the preliminary discharge position is switched when a cumulative total amount of discharged ink exceeds a predetermined value.

7. The inkjet recording apparatus according to claim 6, wherein when the cumulative total amount of discharged ink exceeds the predetermined value, the preliminary discharge to the cap, of which the distance from the recording means is the second distance only, is performed.

8. The inkjet recording apparatus according to claim 1, wherein in a type of the recording medium, a number of recording media and a recording mode in image forming, sent from a host apparatus to the inkjet recording apparatus, are stored, and control of the preliminary discharge position is switched according to the stored information.

* * * * *